United States Patent [19]

Covert

[11] 4,349,998

[45] Sep. 21, 1982

[54] CARTON INSPECTING AND CONVEYING APPARATUS

[75] Inventor: William J. Covert, Blue Anchor, N.J.

[73] Assignee: Garvey Corporation, Blue Anchor, N.J.

[21] Appl. No.: 169,398

[22] Filed: Jul. 16, 1980

[51] Int. Cl.[3] ..... B65B 57/02

[52] U.S. Cl. ..... 53/53; 53/75; 493/16; 209/597

[58] Field of Search ..... 53/53, 75, 374–375; 493/9, 8, 16; 209/597

[56] References Cited

U.S. PATENT DOCUMENTS

| | | | |
|---|---|---|---|
| 2,080,266 | 5/1937 | Gwinn et al. | 53/53 |
| 2,675,119 | 4/1954 | Birch | 198/34 |
| 3,127,721 | 4/1964 | Burton | 53/53 |
| 3,176,839 | 4/1965 | Whitecar | 209/597 X |
| 3,197,045 | 7/1965 | Nevo-Hacohen | 214/16.1 |
| 3,340,992 | 9/1967 | Seragnoli | 198/24 |
| 3,343,691 | 9/1967 | Anderson | 214/7 |
| 3,360,100 | 12/1967 | Seragnoli | 198/347 |
| 3,450,246 | 6/1969 | Seragnoli | 198/24 |
| 3,466,843 | 9/1969 | Mumper | 53/137 |
| 3,496,048 | 2/1970 | Wooten et al. | 156/363 |
| 3,499,555 | 3/1970 | Wahle | 214/16.4 |
| 3,518,805 | 7/1970 | Udall et al. | 53/53 |
| 3,606,014 | 9/1971 | Linn | 53/53 X |
| 3,734,266 | 5/1973 | Despres | 198/24 |
| 3,754,632 | 8/1973 | Kruetter | 198/20 R |
| 3,777,867 | 12/1973 | Durwald | 198/26 X |
| 3,847,267 | 11/1974 | Patten, Jr. | 198/20 R |
| 3,939,063 | 2/1976 | Epperson et al. | 209/597 X |
| 4,011,155 | 3/1977 | Feurstein et al. | 53/53 X |

*Primary Examiner*—James F. Coan

*Attorney, Agent, or Firm*—Anthony A. O'Brien

[57] ABSTRACT

A carton inspecting and conveying apparatus is disclosed as including a lower horizontal conveyor formed by two parallel spaced plastic chain loops with retractable pawls therebetween for stopping cartons at stations along the conveyor. At one such station, jets of air are directed at each carton to open any improperly sealed flaps, open flaps being photoelectrically detected. A pneumatic ejector at a subsequent station is selectively actuated by an electronic control unit responsive to the photodetector to remove unsealed cartons from the conveyor. A pneumatic lifting head is provided to transfer cartons from the conveyor to an accumulator column in the event of a carton backup. An elevator having platforms passing between the plastic chains lifts cartons from the lower conveyor, and a rotary transfer device places them on an upper outfeed conveyor belt.

7 Claims, 7 Drawing Figures

136
142
128
138
140
162
196
156
186
184
132
130
174
194
168
170
120
190
188
146
144
146
10
14
116
126
150
7
118
6
106
88
92
5
44
42
76
52
46
114
52
52
52
3
3
28
18
32
110
112
66
74
82
86
20
94
98
6
5
206
202
148
38
40
12
204
7
208
200

CARTON INSPECTING AND CONVEYING APPARATUS

BACKGROUND OF THE INVENTION

1. Field of the Invention

This invention relates to an apparatus for inspecting and conveying articles, particularly cigarette cartons. More particularly, the invention is directed to a conveyor for transferring cigarette cartons in series from a lower location to an upper location and for automatically inspecting the cartons for proper flap sealing.

2. Description of the Prior Art

The prior art is exemplified by U.S. Pat. Nos. 3,340,992, 3,343,691, 3,466,843, 3,496,048, 3,499,555 3,734,266, 3,777,867 and 3,847,267.

U.S. Pat. No. 3,466,843 provides a carton closing and taping machine wherein movement of cartons on a gravity rollerway regulated by a retractable stop at the end of a lever. U.S. Pat. No. 2,675,119 describes a box conveyor surface formed by parallel chains running in respective guide troughs. In U.S. Pat. No. 3,496,048 pneumaically actuated gates control passage of cartons along a conveyor in response to signals from a photocell. Pivoted levers in U.S. Pat. No. 3,777,867 maintain spacing between successive pallets on a roller conveyor. U.S. Pat. No. 3,734,266 provides a pneumatically actuated ram for pushing articles of one conveyor and onto another. U.S. Pat. No. 3,499,555 discloses a pneumatically operated transfer mechanism for diverting articles on a conveyor to a storage column, and U.S. Pat. No. 3,340,992 provides a storage column with latches as its lower end to support articles within the column. Conveyors associated with rotary devices for transferring articles from or onto conveyors are shown in U.S. Pat. Nos. 3,847,267 and 3,343,691. One drawback of the known prior art conveyors is that they are not capable of selectively rejecting improperly sealed articles from a product stream.

SUMMARY OF THE INVENTION

The invention is summarized in a carton conveying and inspecting apparatus including a continuously movable conveyor for transporting a series of cartons, periodically actuated means for arresting the movement of the cartons at each of a plurality of locations along the conveyor, means for sensing unsealed flaps on the cartons, an ejector for selectively removing cartons from the conveyor surface at a location downstream of the sensing means, and means responsive to the sensing means for actuating the carton ejector as a carton having an unsealed flap passes the ejector.

An object of the invention is to remove automatically improperly sealed cigarette cartons from a series of cartons on a conveyor.

Other objects, advantages and features of the invention will be apparent from the following description taken in conjunction with the accompanying drawings.

DESCRIPTION OF THE PREFERRED EMBODIMENT

Figure 2:
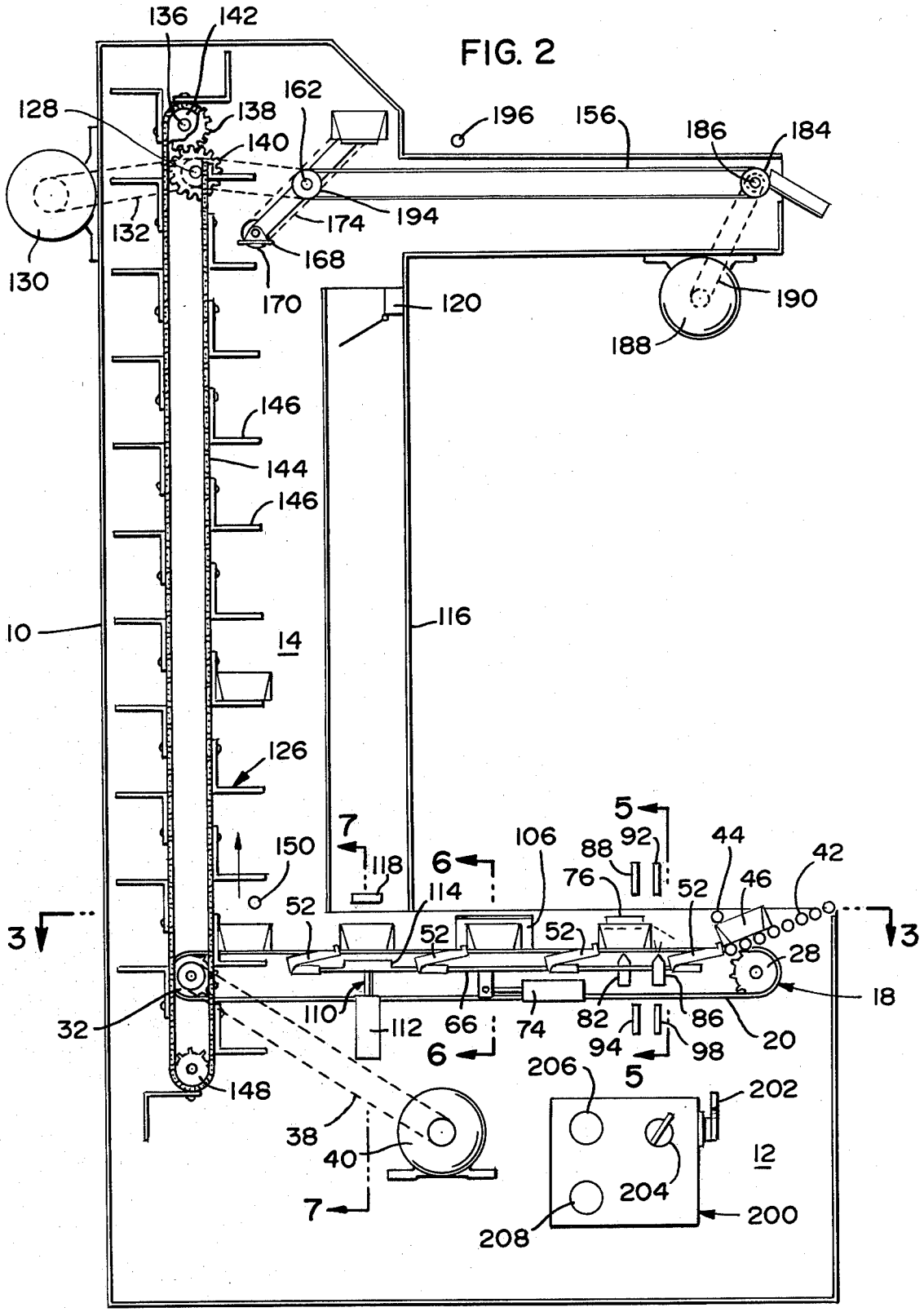
FIG. 2 is a sectional view taken along the line 2—2 in FIG. 1.

Referring to FIG. 2, the present invention is embodied in an apparatus 10 for inspecting and elevating cigarette cartons, including a lower section 12, an intermediate section 14 and an upper section 16, each section having a frame formed from sheet metal. Details of the frames are omitted from the drawings for the sake of clarity.

Figure 3:
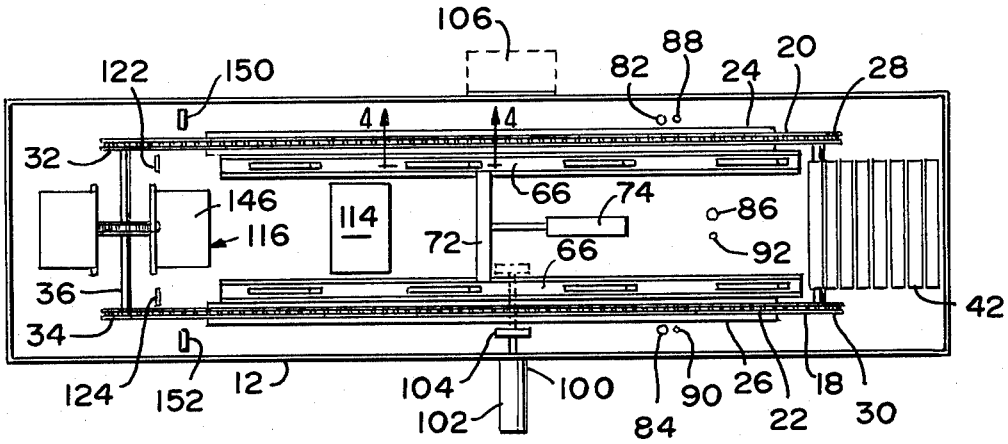
FIG. 3 is a top plan view of a portion of the apparatus taken along the line 3—3 in FIG. 2.

As shown in FIGS. 2 and 3, the lower section 12 supports a substantially horizontal lower conveyor indicated generally at 18, which includes a spaced pair of plastic chain loops 20 and 22. The upper portion of the loops 20 and 22 ride in channels 24 and 26 to maintain the top surface of the conveyor 18 flat regardless of the amount of slack in the loops 20 and 22.

The chain loops 20 and 22 ride on a pair of idler sprockets 28 and 30 at one end of the conveyor 18; at the other end, the loops 20 and 22 engage drive sprockets 32 and 34 fixed upon a driveshaft 36 which is rotated through appropriate linkage indicated schematically as 38 (FIG. 2) by a lower gear reduction motor 40. Conventional bearings and chain slack adjusters (not shown) are provided as necessary throughout the apparatus.

An inclined roller raceway 42 is positioned over the input end of the lower conveyor 18 to gravity feed cartons from upstream machinery onto the chains 20 and 22. A confinement roller 44 is spaced above the raceway 42 to engage the top surfaces of a series of cartons 46 as they enter the conveyor 18. The cartons 46, which are shown on the conveyor in FIGS. 2, 5, 6 and 7, are oriented with their two end flaps and a single back flap facing downward, the back flap being rearward.

Figure 4:
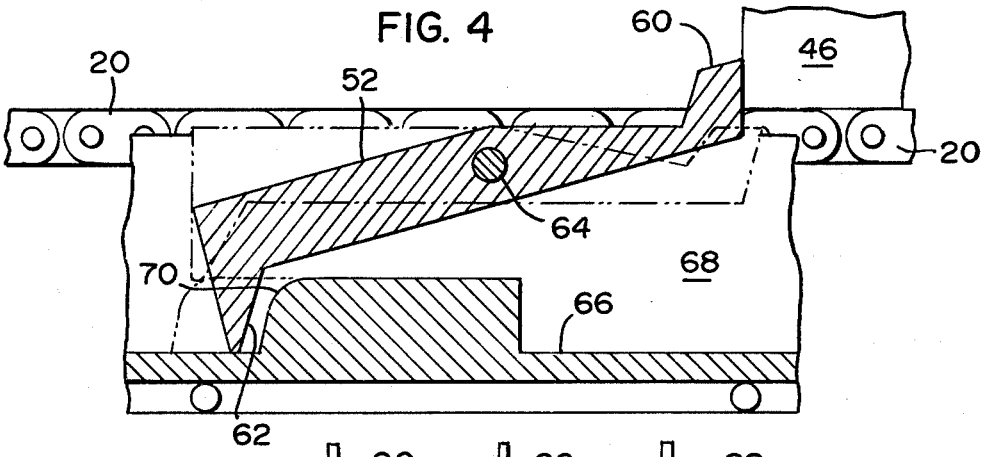
FIG. 4 is a sectional view taken along the line 4—4 in FIG. 3.
Figure 5:
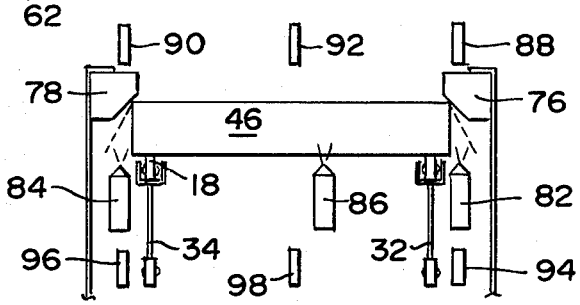
FIG. 5 is a sectional view taken along the line 5—5 in FIG. 2.

An escapement mechanism provides periodically actuable means for arresting cartons at points along the conveyor 18, thereby defining a series of stations at which various functions are performed. The escapement mechanism includes four pairs of pivotally mounted pawls 52. As shown in detail in FIG. 4, each pawl 52 has an upwardly projecting finger 60 at one end and a downwardly extending cam surface 62 at the other end. The pawl 52 is pivotally supported by a pin 64, and since the center of gravity of the pawl lies between the pin 64 and the cam surface 62, the finger 60 normally protrudes above the surface of the conveyor to halt movement of cartons 46 by the chains 20 and 22. However, the finger 60 may be retracted below the conveyor surface, as shown by broken lines in FIG. 4, to release the cartons thereon. An actuator bar 66 supported in an actuator channel 68 is situated below the series of pawls. The bar 66 has a rounded shoulder 70 below each of the pawls for engaging a respective cam surface 62 when the actuator bar 66 is displaced toward the intermediate section 14. Referring to FIG. 3, a pair of actuator bars 66 are joined by a transverse plate 72 whereby all eight fingers 60 can be retracted in unison by forward movement of the plate 72. The transverse plate 72 is secured to appropriate means for displacing the actuator bars, such as the piston end of a double acting pneumatic cylinder 74 attached to the lower section 12. Air pressure is periodically applied to the escapement cylinder 74 to release the escapement pawls as described hereafter.

A pair of guide blocks 76 and 78 (FIGS. 3 and 5) having bevelled inner surfaces 80 are located above the conveyor 18 in such a position as to engage the upper edges of the ends of cartons 46 traveling along the conveyor 18. Air jets 82 and 84 located beneath the respective guide blocks are directed upwardly at the end flaps of a carton 46 on the conveyor 18. A third air jet 86 between the conveyor chains 20 and 22 is directed upwardly at the back flap of the carton. Optical sources 88, 90 and 92, preferably infrared light emitting diodes, and infrared phototransistor sensors 94, 96 and 98 spaced along vertical axes defining optical paths near the air jets 82, 84 and 86 respectively inspect the carton 46 for unsealed flaps as described subsequently.

Figure 6:
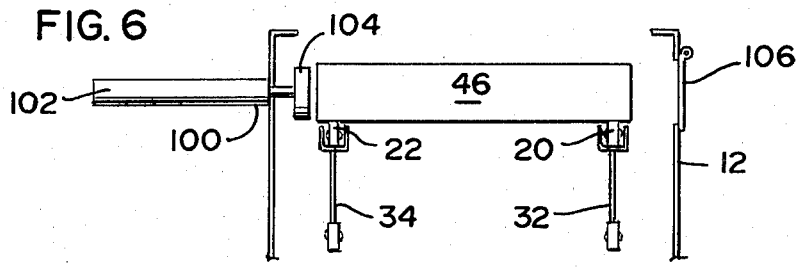
FIG. 6 is a sectional view taken along the line 6—6 in FIG. 2.
Figure 7:
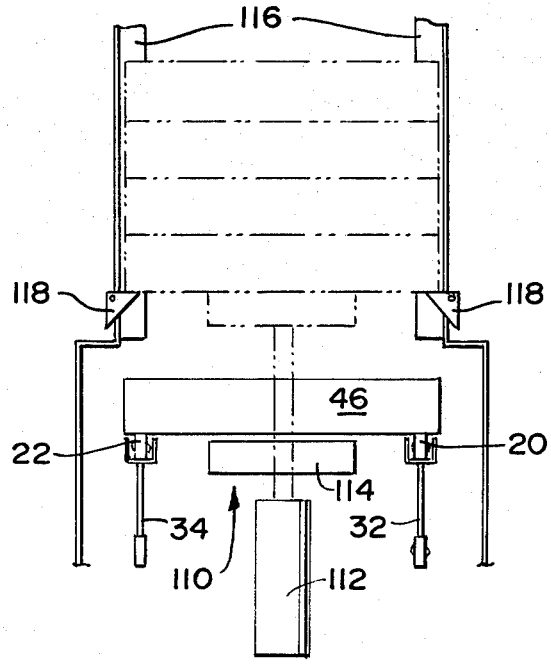
FIG. 7 is a sectional view taken along the line 7—7 in FIG. 2.

Further along the conveyor 18, as shown in FIGS. 3 and 6, a carton ejector 100 including a pneumatic cylinder 102 with a plastic head 104 attached to the piston end thereof is disposed on one side of the section 12 along an axis transverse to and slightly above the conveyor 18. The ejector 100 has approximately a three-inch stroke and is normally retracted so that the head 104 is clear of the path followed by cartons on the conveyor. A guide plate 106 mounted on the frame on the side opposite the ejector 100 is spring biased toward a normally closed vertical position, but can swing upward away from the frame 12 to allow defective cartons to be ejected from the conveyor 18.

A carton accumulator indicated generally as 110 (FIGS. 2 and 7) includes a vertically oriented pneumatic cylinder 112 that operates a lifting head 114. The lifting head 114 is normally retracted below the level of and between the conveyor chains 20 and 22, but can be raised by the cylinder 112 to store cartons on the conveyor chains in a vertical carton storage column 116 directly above. Latches 118 which are gravity biased closed permit the upward passage of cartons 46 into the storage column 116 and support the lowermost carton when the lifting head 114 is retracted. An electromechanical switch 120 located near the top of the storage column 116 is tripped by the uppermost carton when the column 106 is filled.

Referring now to FIG. 2, the elevator section 14 extends upwardly from the lower section 12 near the downstream end of conveyor 18. A pair of plastic stops 122 and 124 (FIG. 3) attached to the frame of the elevator 14 halt cartons 46 at the end of the conveyor 18 so that they may be intercepted by an elevator conveyor designated generally as 126.

Near the upper end of the elevator 116, a countershaft 128 (FIGS. 1 and 2) is driven by a gear reduction upper motor 130 via an upper drive chain 132 and an upper drive sprocket 134. A segment of the elevator conveyor has been omitted from FIG. 2 for clarity. The countershaft 128 in turn drives an elevator axle 136 through a pair of gears 138 and 140. A driven sprocket 142 mounted on the axle 136 carries a loop of elevator chain 144 from which metal platforms 146 extend perpendicularly at intervals. The lower end of the elevator chain 144 runs on an idler sprocket 148. In order to protect the elevator drive mechanism against overload, a torque limiting friction clutch (not shown) is preferably included in the drive.

An optical source 150 and sensor 152 (FIG. 3) are mounted transversely across the path followed by the platforms 146 to generate trigger signals which are used to synchronize all of the functions of the apparatus 10 as described below.

Figure 1:
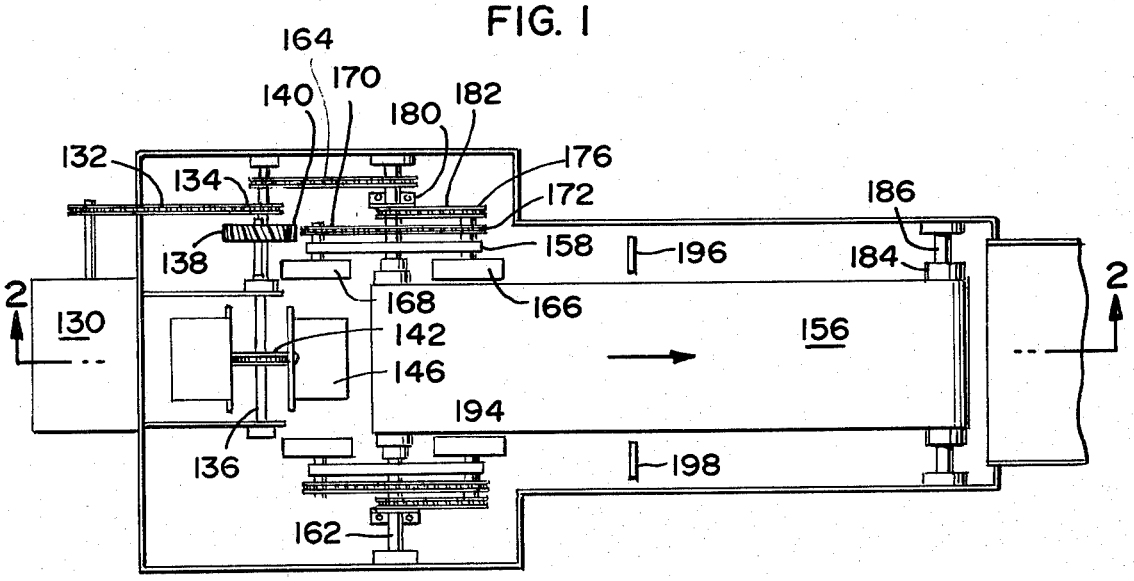
FIG. 1 is a top plan view of an apparatus embodying the invention, with parts removed for clarity.

Referring to FIGS. 1 and 2, a ferris wheel type carton lifter is located near the top of the elevator section 14 to transfer cartons from the elevator platforms 146 to a horizontal outfeed conveyor 156. The carton lifter includes a pair of transversely spaced arms 158 and 160 mounted on a common axle 162 driven by a chain 164 from the countshaft 128. The arm 158 has platens 166 and 168 rotatably mounted along transverse axes through the ends thereof. The platens 166 and 168 are attached to sprockets 170 and 172 respectively which carry a loop of chain 174 to maintain the platens in parallel relationship with each other. One platen 168 is further attached to an indexing sprocket 176. A fixed sprocket 178 is rotatably mounted on the axle 162, but is prevented from rotating thereon by a stationary plate 180. A chain 182 is looped around the sprockets 176 and 178, the platens 166 and 168 having been indexed to a horizontal position. The arm 160, not shown in FIG. 2, carries a pair of platens which are similarly constrained and indexed, so that all four platens remain horizontal as they revolve around the axle 162. The gears 138 and 140 are sized so that the speed of the carton lifter platens exceeds that of the vertical conveyor platforms 128, enabling the platens 166 and 168 to remove cartons from the platforms 146.

The upper section 16 supports the outfeed conveyor belt 156 which extends in a loop around a driven roller 184 mounted on an axle 186 that is rotated by a motor 188 via a chain 190. A freewheeling roller 194 rides on the carton lifter axle 162, and the conveyor belt 156 runs in a loop on rollers 184 and 194. A fifth photoelectric source 196 and sensor 198 are positioned transversely above the outfeed conveyor 156 to detect abnormal product backup.

Referring to FIG. 2, the apparatus includes an electropneumatic control unit 200 that provides current to the motors 40, 130 and 188, and to the optical sources 88, 90, 92, 150 and 196. The control unit 200 includes a door interlock switch 202, a manual automatic mode switch 204, a start button switch 206 and a stop button switch 208. The control unit 200 receives input from the five optical sensors 94, 96, 98, 152 and 198, and from the limit switch 120. When the apparatus is operated in the automatic mode, the control unit 200 periodically applies pressurized air to the air jets 82, 84 and 86, and to the escapement cylinder 74 in synchronization with trigger signals produced by passage of platforms 146 through the optical path of the photodetector 152. The ejector cylinder 102 and the accumulator cylinder 112 are selectively actuated by the control unit 200 in response to signals from the appropriate photodetectors as described below.

To operate, an operator places switch 204 in the automatic mode position and depresses the start button 206, thereby activating the conveyor motors 40, 130 and 188 and illuminating the optical sensors 88, 90 and 92. The movement of elevator platforms 146 past the optical sensor 152 creates a series of trigger signals for the control unit 200 which applies air pressure periodically to the escapement mechanism cylinder 74 and to the air jets 82, 84 and 86.

A carton 46 from a neighboring device such as a carton packer is fed to the raceway 42 (FIG. 2) down which it slides until its forward edge abuts the projecting fingers 60 of the first pair of escapement pawls 52. The confinement roller 44 insures that the carton 46 does not jump over the fingers 60. The control unit 200, in response to an electrical signal produced by the movement of a platform 146 past the optical sensor 152, applies air pressure to the escapement mechanism air cylinder 74, momentarily retracting the pawl fingers 60 below the level of the lower conveyor 18. The carton 46 is then free to slide from the raceway 42 onto the conveyor chains 20 and 22, which support it and carry it under the guide blocks 76 and 78, to align it transversely if necessary. The bevelled edges 80 engage only the upper end edges of the cartons 46 so as not to hold the flaps shut. The carton 46 continues along the conveyor until it is arrested by the projecting fingers 60 of the second pair of pawls, whereupon the conveyor chains 20 and 22 slide along the bottom of the carton 46. The first pair of pawls 52 now restrain the following carton 46 a distance behind, preventing it from holding the back flap of the carton 46 closed. With the carton 46 arrested over the air jets 82, 84 and 86, the control unit 200 momentarily applies air pressure to the jets, which direct air at each of the three carton flaps. If any flap is blown open, the optical path of the appropriate photodetector is broken, generating a signal for processing by the control unit 200.

The escapement mechanism releases the carton 46, which moves along the conveyor until it abuts the third pair of pawls 52 and transversely engages the guide plate 106. If an open flap was detected during the previous cycle at the inspection station, a delayed signal from the control unit 200 actuates the ejector air cylinder 102, whereupon the ejector head 104 pushes the carton 46 transversely off the conveyor 18. The guide plate 106 swings open to allow the carton 46 to exit and then closes under its spring bias.

A carton 46 that has not been rejected passes subsequently to the accumulator 110 which normally is inactive. However, when there is an abnormal backup condition on the outfeed conveyor 156, i.e., when the optical path of the photodetector 170 remains continuously broken for a certain period of time such as one-half second, the control unit 200 actuates the accumulator cylinder 112 at each successive cycle so that the accumulator head 114 diverts each carton 46 from the conveyor 18 into the storage column 116. The cycle recurs until the control unit 200 is manually reset by pushing the start button 206 or until the limit switch 120 on the storage column 116 is tripped. In the latter case, the control unit 200 shuts off all of the conveyor motors 40, 130 and 188, and the operator must manually clear the storage column 116 as well as the outfeed conveyor 156 and must thereafter push the start button 206 in order to resume normal operation.

When the escapement fingers 60 are again retracted, the carton 46 (providing that it has not been removed from the lower conveyor 18 by the accumulator head 114) passes to the elevator 126 where it is arrested by the plastic stops 122 and 124. The carton 46 is engaged from below by an elevator platform 146 and is raised by the elevator conveyor 126 to the level of the ferris wheel carton lifter 154, whose platens 166 and 168 overtake the carton from below, lifting it off the elevator platen 146 and depositing it on the moving surface of outfeed conveyor 156. The carton 46 passes through the optical path of the outfeed sensor 198 as previously discussed, and is then fed to a downstream machine such as a case packer.

An advantage of the invention is that it automatically locates improperly sealed cartons and rejects them from the product stream. Another advantage is that irregularities or blockages of product flow are automatically dealt with so that only minimal supervision of the machinery is required.

Inasmuch as the invention is subject to many modifications, variations, and changes in detail, it is intended that all matter contained in the foregoing description or shown in the accompanying drawings shall be interpreted as illustrative and not in a limiting sense.

What is claimed is:

1. A carton inspecting and conveying apparatus comprising a continuously movable conveyor surface for transporting a series of cartons;

periodically actuated means for arresting the movement of the cartons at each of a plurality of locations along the conveyor;

means for sensing unsealed flaps on the cartons;

an ejector for selectively removing cartons from said conveyor surface at a location downstream of said sensing means; and means responsive to said sensing means for actuating the ejector as a carton having an unsealed flap passes the ejector;

said carton arresting means including means defining a fixed channel, a plurality of pawls pivotally mounted within the channel, a finger extending upward from one end of each pawl, a cam surface at the end of the pawl opposite the finger, said pawls each being capable of limited rotation between a first position in which the fingers extend above the conveyor surface to arrest cartons thereon and a second position in which the fingers are withdrawn below the conveyor surface, the pawls being gravity biased toward said first position, an actuator bar slidably contained within the channel beneath the pawls, a plurality of shoulders on said actuator bar, one shoulder beneath each pawl for engaging a respective cam surface, and means for periodically displacing said actuator bar within said channel whereupon said shoulders engage said cam surfaces simultaneously to rotate said pawls to said second position to release cartons on the conveyor surface.

2. An apparatus as recited in claim 1 wherein the sensing means comprises an air jet directed across each carton flap so as to blow open any unsealed flap, an optical source, and an optical sensor aligned with the source along an optical path that is broken by an open carton flap.

3. An apparatus as recited in claim 2 wherein the optical source is a light emitting diode and the optical sensor is a phototransistor sensor.

4. A carton inspecting and conveying apparatus comprising a continuously movable conveyor surface for transporting a series of cartons;

periodically actuated means for arresting the movement of the cartons at each of a plurality of locations along the conveyor;

means for sensing unsealed flaps on the cartons;

an ejector for selectively removing cartons from said conveyor surface at a location downstream of said sensing means;

means responsive to said sensing means for actuating the ejector as a carton having an unsealed flap passes the ejector;

said sensing means including an air jet directed across each carton flap so as to blow open any unsealed flap, an optical source, and an optical sensor aligned with the source along an optical path that is broken by an open carton flap; and a pair of guide blocks for transversely aligning the cartons with respect to the air jets, said guide blocks having bevelled surfaces which engage the cartons only along their upper edges.

5. A carton inspecting and conveying apparatus comprising a lower horizontal conveyor for cartons;

an upper horizontal conveyor;

an elevator for transferring cartons from the lower conveyor to the upper conveyor;

said elevator including a lower idler sprocket, an upper driven sprocket, an endless chain extending in a loop around said sprockets, and a plurality of platforms attached at intervals perpendicular to said chain;

a photodetector for detecting a stoppage of cartons on the upper conveyor;

a carton accumulator;

means responsive to said photodetector for storing cartons on the lower conveyor in the accumulator when carton stoppage on the upper conveyor is detected; and a carton lifter including a driven shaft, a pair of spaced parallel arms attached at their midpoints perpendicular to said shaft, four horizontal platens, one rotatably supported at each end of each arm so as to pass on either side of said platforms as the shaft is rotated, and gears interconnecting said driven shaft and said driven sprocket at a speed ratio such that said platens have a greater speed than said platforms.

6. An apparatus as recited in claim 5 wherein the accumulator comprises a vertical column for containing cartons, a latch mechanism to support the lowermost of cartons in the column while allowing additional cartons to enter the column from below, a pneumatic cylinder below the lower conveyor surface, and a lifting head attached to said pneumatic cylinder for transferring cartons from said lower conveyor into said column.

7. An apparatus as recited in claim 5 further comprising switch means near the top of the column for deactivating the conveyor when the accumulator is full.

* * * * *